United States Patent [19]

Lardennois et al.

[11] 3,964,702

[45] June 22, 1976

[54] ANTI-COLLISION SAFETY DEVICE FOR A PASSENGER TRANSPORT SYSTEM ON TRACKS

[75] Inventors: Regis Lardennois, Verriere-le-Buisson; Michel Robert, Gif-sur-Yvette; Robert Gabillard, Lille; Edouard Rubin, Bures-sur-Yvette, all of France

[73] Assignee: Engins Matra, Paris, France

[22] Filed: Jan. 29, 1975

[21] Appl. No.: 544,916

[30] Foreign Application Priority Data

Jan. 15, 1973 France ..... 7301345

Related U.S. Application Data

[63] Continuation-in-part of Ser. No. 432,811, Jan. 14, 1974, abandoned.

[52] U.S. Cl. ..... 246/4; 235/150.24; 246/167 D; 246/167 R

[51] Int. Cl.[2] ..... B61L 27/04

[58] Field of Search ..... 246/187 C, 187 B, 1 R, 246/1 C, 63 C, 122 R, 167 D, 5, 25, 167 R; 235/150.24

[56] References Cited

UNITED STATES PATENTS

| | | | |
|---|---|---|---|
| 3,268,727 | 8/1966 | Shepard | 246/187 C |
| 3,361,905 | 1/1968 | Baughman | 246/187 C |
| 3,626,177 | 12/1971 | Franke | 246/1 R |
| 3,819,932 | 6/1974 | Aver | 246/1 R |

*Primary Examiner*—Trygve M. Blix
*Assistant Examiner*—Reinhard J. Eisenzopf
*Attorney, Agent, or Firm*—Kinzer, Plyer, Dorn & McEachran

[57] ABSTRACT

An anti-collision safety control for vehicles travelling on tracks; the control comprises two safety loops per vehicle, linked to two common loops in a central control station. Each vehicle loop comprises control circuits for determining the distance to the next preceding vehicle, for determining a safe stopping distance for the vehicle, and for stopping the vehicle if the distance to the preceding vehicle becomes smaller than the safe stopping distance or if there is a failure of a safety circuit. The distance control circuit comprises a detector for detecting reference points provided along the track, a counter for calculating the distance of a vehicle from a given zero location, and a delay circuit for converting this distance into a position signal timed to a synchronization pulse received by all vehicles. Position signals from all vehicles are transmitted to the central control and back to the vehicles; the distance to an immediately preceding vehicle is determined by comparing the position pulses.

10 Claims, 4 Drawing Figures

ANTI-COLLISION SAFETY DEVICE FOR A PASSENGER TRANSPORT SYSTEM ON TRACKS

CROSS-REFERENCE TO RELATED APPLICATION

This application is a continuation-in-part of application Ser. No. 432,811, filed Jan. 14, 1974 now abandoned.

The present invention relates to an anti-collision safety device designed especially for use in vehicles travelling on tracks. The term "vehicle" as used herein is intended to include both individual vehicles and multi-vehicle trains.

Anti-collision devices are already known which comprise safety loops communicating with a central control station, as well as means for determining the distance between two successive vehicles and determining the safe distance between two vehicles in order to cause a vehicle to stop, when the distance between two consecutive vehicles becomes smaller than the safe distance or if there is a failure of a safety circuit.

The known systems have a number of disadvantages, linked as much to their complex technical nature as to safety defects or lack of flexibility.

The principal object of the present invention is to overcome these disadvantages and provide an anti-collison safety device for vehicles travelling on tracks, without any driving personnel, that is to say, a device which itself can estimate risks and react in consequence.

More generally, the invention is intended to provide a device comprising means of observation and making decisions for safe operation, using in particular the principle of deformable movable blocks.

To this end, the present invention relates to an anti-collision safety device of the type indicated above, characterized in that it comprises means for detecting and counting reference points provided along the track, means for calculating the distance of a vehicle from a given zero point, and means for converting this distance into a time with a time reference constituted by a synchronization pulse received by all the vehicles. The device further comprises means for generating a series of position pulses, emitted by all the vehicles and received by all the vehicles, the distance between a vehicle and the vehicle immediately preceding it being determined by comparing the position pulses; further, the safety device of each vehicle compares this relative distance with its stopping distance and causes the vehicle to stop when the relative distance is smaller than the stopping distance.

According to another characteristic feature of the invention, the stopping distance is determined from the actual speed of the vehicle, which may be obtained by a tachometer (e.g., a phonic wheel) supplying speed signals to a function generator which is initialized by the position pulse and which furnishes an output signal as soon as the function generator has reached the actual vehicle speed, the vehicle being caused to stop if the signal from the function generator does not lie within the distance between the vehicle and the vehicle immediately preceding it (relative distance window).

According to another characteristic feature of the invention, an alarm is given by a position alarm device set off separately or in combination by a breakdown of the reference point detector, a beakdown of the reference point counter, or a transmission breakdown. This alarm is transmitted to the central control station (PCC) by the emission of a pulse characteristic of a vehicle, and the central station PCC then distributes a general brake or line emergency stop signal that stops all vehicles on the line.

According to another characteristic feature of the invention, the safe operation of the loop functions (calculaton of position, calculation of stopping distance) is controlled by the signals supplied by duplicate breakdown detecting circuits, the output signals from the means checking for intrinsic safety the coincidence of the output signals of the duplicate circuits, the absence of coincidence characterizing a breakdown or a risk of collision and causing stopping.

It is particularly important that the duplication of functions is effected by means of non-symmetrical loops.

Each vehicle comprises two complete safety loops. The central control station also comprises two complete loops, combined with the two respective loops in each vehicle. The signals furnished by the two loops are compared for coincidence, which improves the reliability of the device. If each loop is in a state of alarm simultaneously, the safety device causes an emergency stop of the line.

According to another characteristic feature of the invention, the line emergency stop signal is transmitted to the central control station by means of a logical circuit connected to a transmitter transmitting on a safety frequency received by a receiver, any failure in reception of the transmission from the vehicle resulting in an emergency stop.

Thus, in a general manner, according to the invention, positive safety is achieved solely by using unit functions. Thus, use is made of the logical function AND and the coincidence logical function which is a sampled AND function. By means of the coincidence function, the simultaneous presence of logical states is checked at given moments and for a given duration.

In the safety device, the functions are duplicated by using different circuits and checking the coincidence of the output signals. This assembly of means will hereafter be called "auto-control."

The basic advantage of the invention resides in the absence of equipment on the ground with the exception of a series of studs spaced along the track. This minimizes maintenance and results in considerable cost saving.

Because of its high performance, the invention enables infra-structure to be used to its maximum. As an example, the frequency of trains can be increased by 50 percent over that of conventional systems, which usually require at least a 90 second interval between trains, whereas with the present invention, the interval can be reduced to 60 seconds.

A distinguishing feature of the device is its low manufacturing cost, its very high safety level and its great reliability.

In addition, the invention requires virtually no electro-mechanical devices. It is very flexible in its use, and can be fitted to any system of tracks, which need not necessarily be automated.

The present invention will now be described in greater detail with the aid of an embodiment of the anti-collision safety device for vehicles travelling on tracks.

According to the invention, in a transport system on tracks, to avoid collision between two vehicles (or trains), the device must maintain, between each vehicle and the following vehicle, a space greater than or equal to the safe stopping distance for the following vehicle. To simplify the account, only the term "vehicle" will be used. For the safety of each vehicle, it is assumed that at any moment the speed of the preceding vehicle is zero.

If the distance between a vehicle and the preceding vehicle becomes equal to the safe stopping distance of the following vehicle (about the threshold distance), the following vehicle actuates its brakes.

Figure 1:
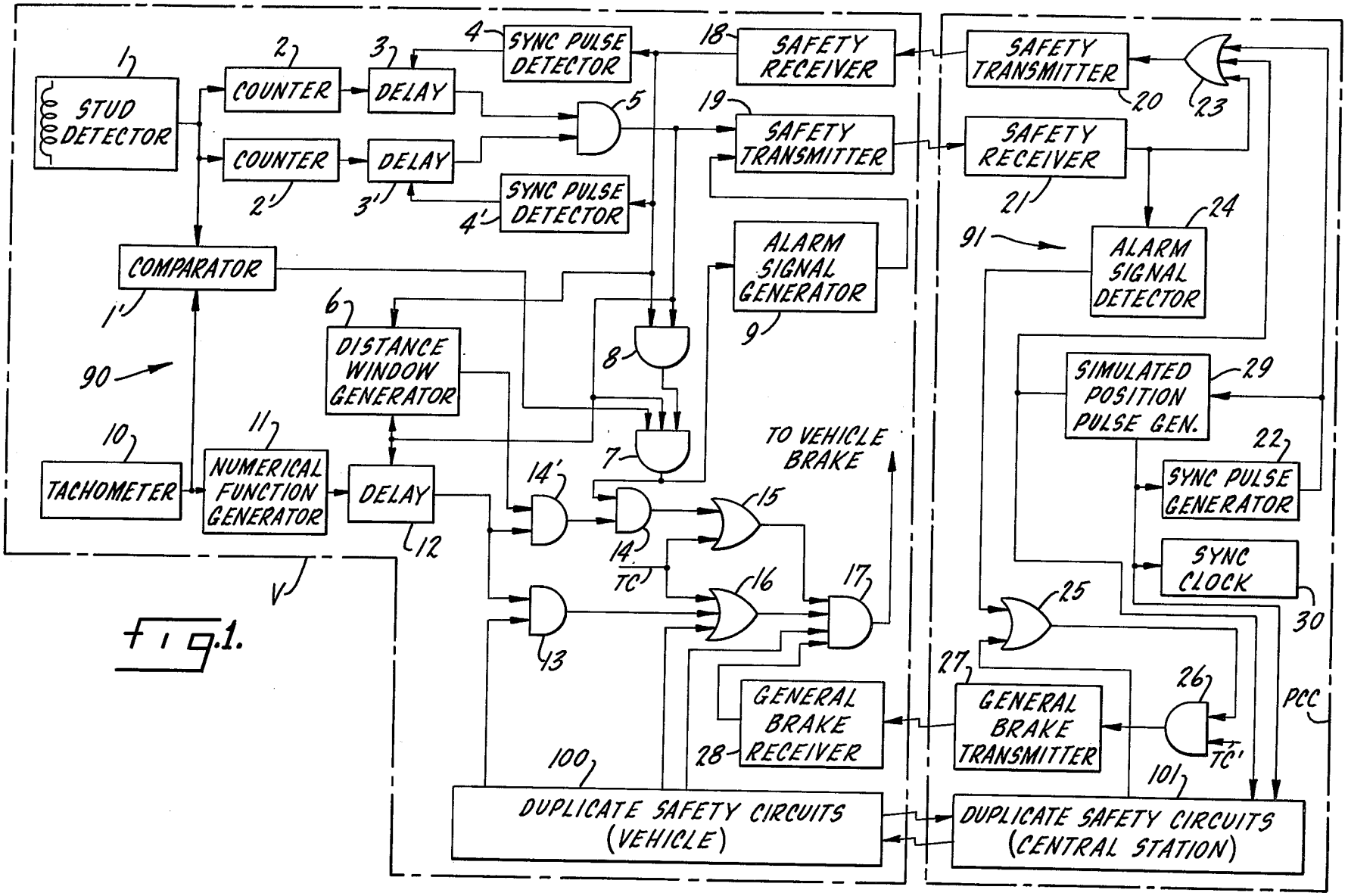
FIG. 1 is a block diagram of a safety control according to the invention.

Thus, in a general manner, the anti-collision safety system consists of a device (V), see FIG. 1, carried on board each vehicle, and a central control station PCC. Station PCC collects data from all vehicles in a given line or network and redistributes the data to the various vehicles. The anti-collision safety device must therefore measure the relative distances between any two vehicles, calculate the safe stopping distance of each vehicle, compare this safe stopping distance with the respective actual distances, and, if necessary, actuate the brakes on any vehicle.

In the following description (see FIG. 1), the construction of the anti-collision safety device will be restricted to its simplest form. This means that a part of the circuit V carried on board the vehicle (safety loop 90) and a part of the central station PCC circuit (safety loop 91) will be described, but this will not be done in detail for the complementary circuits (safety loops 100 and 101).

To measure its relative location, with respect to a zero point on the track, each vehicle is fitted with a stud detector 1 which enables it to determine the distance travelled from a fixed zero point by counting fixed reference points called "studs," located at constant intervals on the track (not shown). Each vehicle transmits the value of this distance to all the other vehicles. The difference between the distance travelled by a preceding vehicle and that which a vehicle has travelled itself gives the relative distance between the two vehicles. It recognizes the distance travelled by the closest preceding vehicle by choosing the received distance that is immediately greater than its own.

By way of example, the studs located on the track may constitute light alloy plates of about 0.1 $m^2$ placed every twenty meters along the track. These studs are detected by each vehicle with the aid of a stud detector placed under the vehicles. Typically, the stud detector may comprise a coil coupled into an oscillator, the coupling of which varies in the presence of a metallic mass (the principle of inductive feedback proximity detectors).

The pulses supplied by the stud detector 1 are recorded by two counters 2 and 2', each reset to zero when the train passes over a measuring zero point (terminal station). The state of these counters measures the distance travelled by the vehicle from the zero point.

The transmission of the state of the counters 2,2' to the other vehicles uses a safety transmission means comprising a transmission line laid on the track (not shown), a transmitter 19 and a receiver 18 mounted on the vehicle, and a transmitter 20 and receiver 21 located at the central control station PCC. At regular time intervals, for example every two seconds, the PCC transmitter 20 applies to the transmission line a synchronization pulse of fixed duration (lasting 20 milliseconds, for example). This synchronization pulse is received by the receiver 18 on each of the vehicles. When a vehicle receives the synchronization pulse, it applies to the transmission line a response pulse or position pulse of predetermined different duration (for example, lasting 4 milliseconds), delayed with respect to the synchronization pulse by a time which is proportional to the current state of the position counters 2,2'. The greatest of these delays is smaller than the period between synchronization pulses (2 seconds). All of the position pulses from the vehicles on the line are received by the central control station PCC and immediately re-transmitted on the transmission line to all the vehicles. On board any of the vehicles, the measure of the distance relative to the next preceding vehicle is effected in the following manner:

As soon as a vehicle has emitted its position pulse, it listens on the line for the responses of the other vehicles. The first pulse received by this vehicle is that of the preceding vehicle. The time between it and its own position pulse is proportional to the relative distance to be measured. This relative distance takes the form of the length (duration) of a square wave which is caused to pass to a logical value of one by the position pulse emitted by the vehicle itself and to be reset to zero by the first position pulse received thereafter. This square wave is called the relative distance window.

CALCULATION OF THE STOPPING DISTANCE

The safe stopping distance d of a train travelling at a given speed V is: $d = aV^2 + bV + c$.

This theorectical stopping distance takes into account the uncertainties of the real value of the "emergency deceleration" response time of the brake and all the imperfections of the system.

The quantities $a$, $b$ and $c$ are coefficients. The calculation of the stopping distance is therefore made on the basis of the actual speed of the train, which may be measured with the aid of a tachometer 10.

Tachometer 10 may comprise a phonic wheel (not shown), which is integral with a guide wheel engaging the track (no tractive effort or braking, thus no slipping). The phonic wheel is a metal disc with teeth regularly spaced along its periphery; these teeth are detected by an inductive feedback detector using the same principle as the stud detector 1. The frequency of the output pulses from tachometer 10 detector is proportional to the speed of the vehicle, as is the frequency of the output pulses from stud detector 1.

The stopping distance is then calculated from the speed of the vehicle by a numerical function generator 11, which may be a conventional read-only-memory (ROM) circuit.

The device of the invention compares speeds and distances and actuates the vehicle brake in the following way:

The relative distance to the preceding vehicle (distance window) is obtained in the form of the duration of a square wave. A simple means of comparing is to also express the safe stopping distance in the form of a signal duration or time. To do this, a stopping distance pulse is generated by a delay circuit 12. The timing for generation of the stopping distance pulse is initiated by the position pulse of the vehicle, which coincides with the leading edge of the distance window, and the delay interval is determined by function generator 11, and hence is proportional to the safe stopping distance.

If this stopping distance pulse is generated during the duration of the distance window signal from circuit 6, the safe stopping distance is smaller than the relative distance between the vehicles; there is therefore no danger of collision and thus no actuation of the emergency brake.

On the other hand, if during the duration of the distance window signal, there has been no stopping distance pulse, the brake is actuated. The detection of the absence or presence of a stopping distance pulse within the distance window pulse is effected by a positive safety coincidence circuit.

The general functions to be carried out have been defined above. To carry them out, use is made of a certain number of unit functional blocks which are represented schematically in FIG. 1.

ON BOARD EACH VEHICLE, IN UNIT V:

safety transmitter 19 and safety receiver 18
extraction of synchronization pulse in detectors 4 and 4'
generation of position pulse by circuits 1, 2, 2', 3, 3' and 5
distance window pulse generation in circuit 6
generation of stopping distance pulse by circuits 11, 12
coincidence circuit 14'

IN STATION PCC:

safety transmitter 20 and receiver 21
clock 22,30 (generation of synchronization pulses).

In addition, on board each train, in order to detect certain breakdowns of the system, there have been provided means for checking:

the stud detector 1 and the tachometer 10, with outputs compared in circuit 11
the transmission check circuit 8.

The block diagram in FIG. 1 shows two independent anti-collision loops 90,91 and 100,101; the operation of only loop 90,91 will be analyzed, along with operation of the common components interconnecting the two loops.

POSITION PULSE GENERATION (FIG. 1)

The output of the stud detector 1 supplies pulses which are counted in two counters 2 and 2'. Preferably, two different forms of counter are employed, so that the counters do not work in the same manner, thus affording additional security. Thus, counter 2 may be a conventional binary counter and counter 2' a known form of pseudo-random counter (shift register with modulo two feedback); other counters can be employed as desired.

The state of each of these counters 2, 2' is converted into a delayed pulse, by the delay circuit 3,3', with respect to a synchronization pulse; the synchronization pulse to delay circuit 3 is derived from a detector 4, whereas the sync pulse to circuit 3' comes from a similar detector 4'. Each of the delay circuits 3 and 3' may comprise a reversible counter fed with a clock signal. This reverse counter is initialized to the value of the stud counter (2 or 2') when the synchronization pulse is received, whereupon the reverse counting operation of the clock immediately begins. When the reverse counter has reached zero state, a 4-millisecond vehicle position pulse is generated.

A coincidence circuit, the AND gate 5, checks to determine if the two output pulses of the two reverse counters, delay circuits 3 and 3', occur in coincidence. If this is the case, gate 5 generates a 4-millisecond position pulse which is applied to the transmitter 19. If not, an emergency stop of the vehicle is effected by a logical control circuit comprising the gates 7, 14, 15 and 17, and a safety alarm signal generated by a circuit 19 is applied to transmitter 19 and sent to the station PCC; there is then no further transmission of position pulses from this loop 90.

DISTANCE WINDOW (FIG. 1)

The square wave representing the relative distance between two vehicles (distance window) is generated by a bistable safety trigger circuit ("AND" of safety loop) 6; it is set to a logical one condition by the position pulse from gate 5, and is reset to zero by the output of the safety receiver 18. Reset occurs on the first position pulse received after the position pulse of this vehicle, which represents the nearest preceding vehicle. A timing diagram of the sync pulse signals, the position pulse signals, and the distance window signal is shown in FIG. 2.

Figure 2:
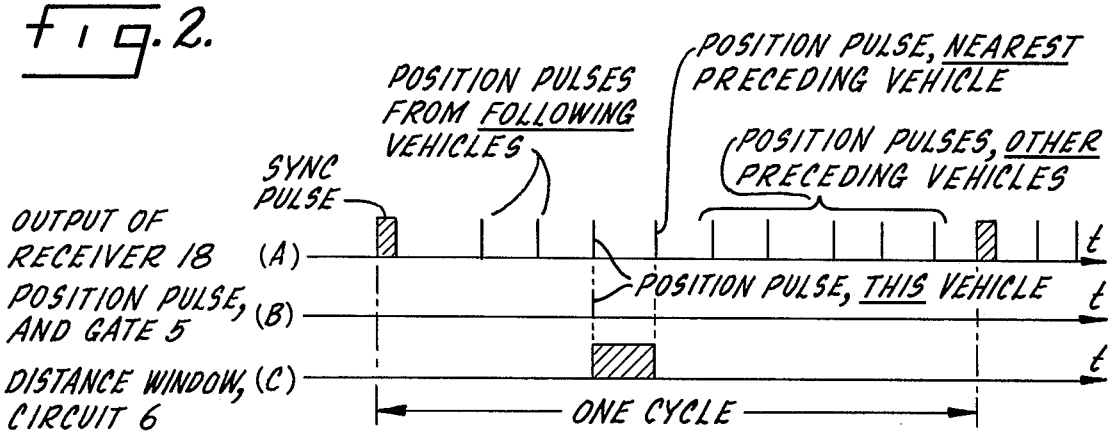
FIG. 2 is a diagram representing the output of the receiver, the position pulses, and the distance window, as a function of time.
Figure 3:
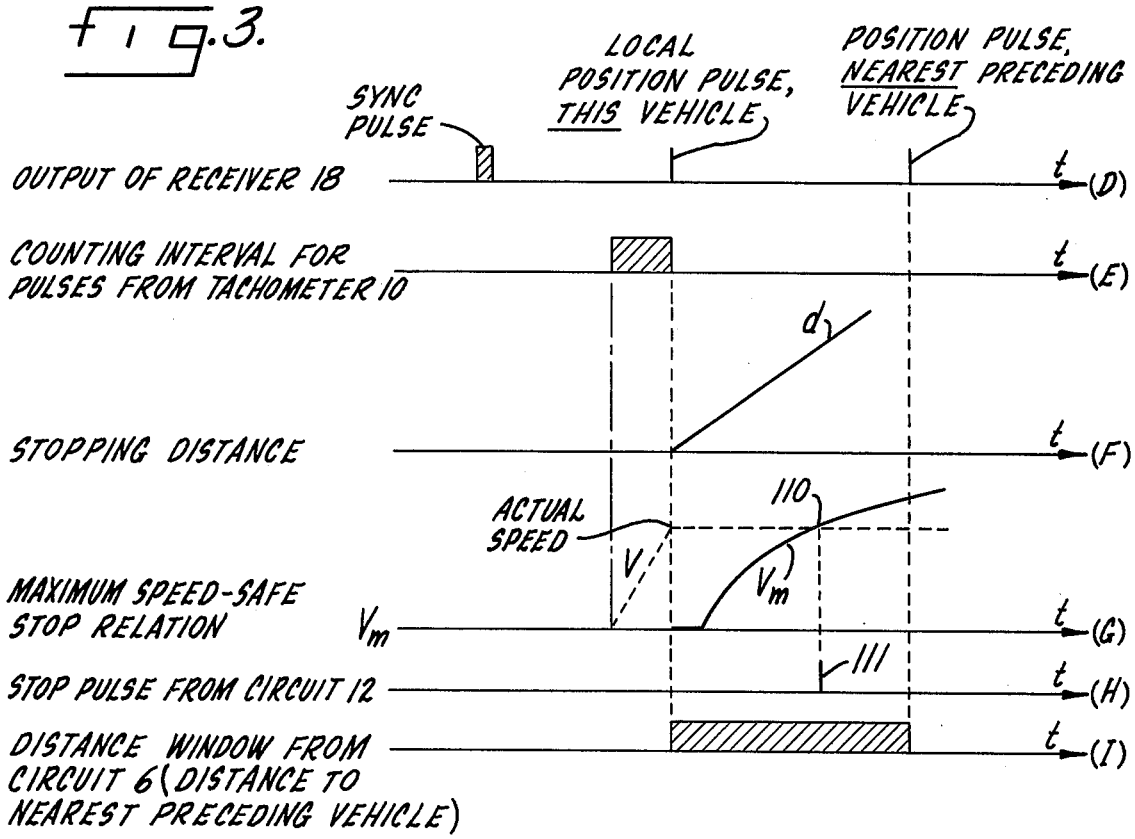
FIG. 3 is a diagram representing respectively, as a function of time, the synchronization and position pulse (D), the time of measuring the actual speed (E), the stopping distance (F), the maximum speed (G), the stopping distance signal (H), and the distance window (I)

The timing diagram for generation of the stopping distance pulse is shown in FIG. 3, in which the first curve D is a repetition of a part of the initial curve A in FIG. 2.

The actual speed of the vehicle is calculated by counting the number of pulses from the tachometer 10 during a defined period, for example, of 300 milliseconds, preceding the position pulse; this time may be obtained by decoding the binary reverse counter used for generating the position pulse.

The stopping distance d is of the form (FIG. 3F):

$$d = aV^2 + bV + C \quad \begin{cases} V \text{ speed} \\ a,b,c\text{: coefficients} \end{cases}$$

The inverted formula gives a maximum speed $V_m$ as a function of the distance *d:*

$$V_m = \frac{1}{2a} \sqrt{b^2 - 4a(c-d)} - \frac{b}{2a}$$

The generator of this function $V_m$ is a programmed memory (ROM) 11 for which the numerical input is a linear number d increasing constantly with time from zero (FIG. 3F). The progression of d is initialized by the position pulse. The output $V_m$ of the memory 11 (curve G) is a quantity which continually increases with time. When $V_m = V$ (V : real speed of the vehicle), a stop pulse 111 is generated; see point 110 in curve G and pulse 111 in curve H.

This stop pulse is delayed with respect to the position pulse by a time which is proportional to the safe stopping distance for the vehicle; see curves G and H in FIG. 3.

A check is made, in each cycle, with the aid of an AND safety gate 14, that during the duration of the distance window pulse from circuit 6, there has been a stopping distance pulse from circuit 12. If not, the emergency brake 17 is actuated through an OR gate 15, since there is a risk of collision.

In each vehicle, two safety loops 90 and 100 are provided, each with a transmitter 19 and a receiver 18 as shown for loop 90. The station PCC is equipped with two transmitter-receiver assemblies 20,21, one for each loop 91 and 101 for the entire assembly of vehicles.

The position pulses from coincidence circuit 5 may be transmitted by the vehicles, as by using amplitude modulation, with the aid of an antenna coupled with a transmission line laid on the ground (not shown).

These pulses are received on this line by the receiver 21 of the station PCC, and are at once re-transmitted by the transmitter 20 with, in addition, a synchronization pulse, by means of the OR gate 23. This transmission may be made using frequency modulation. In addition, the PCC station re-synchronizes the pulses received from the vehicles, which enables transmission delays to be effectively eliminated.

With the aid of an antenna coupled to the transmission line, all the vehicles receive the transmissions of the station PCC; that is, each vehicle receives the response (position) pulses of all the vehicles as well as the synchronization pulses.

In general, the safe operation of the anti-collision function is obtained by using the auto-control means for complex functions and positive safety means for the unit functions.

The detection of the breakdowns of the safety device is effected in the following manner:

Any breakdown of the detectors 1 and 10 is detected by the checking circuit 1'. This circuit compares the outputs of the stud detector 1 and the tachometer 10, and thus measures the length of the inter-stud distances and checks that this length is always close to a constant value. The checking circuit 1' may be an up-down counter, with pulses from detector 1 and tachometer 10 applied to count in opposite directions. A given total count in either direction then indicates a departure from a constant relation between the two inputs, and can be selected to allow a reasonable tolerance.

If the count in circuit 1' exceeds tolerance in either direction, this means that there is a breakdown of the stud detector 1 or of the tachometer 10. A signal is then sent to the safety AND gate 7.

An auto-control circuit is used for the generation of the position pulse. The same function is carried out twice, once in loop 90 and once in loop 100; the position pulse outputs from the two loops are compared by a positive safety coincidence circuit, AND gate 13. The second circuit is shown schematically as rectangle 100 connected to the first circuit by the coincidence gate 13, the OR gate 16, and the AND safety gate 17.

In order to generate the stopping distance pulse, use is made of an auto-control circuit, but this function is carried out only once in each safety loop. Thus, the consequences of a breakdown of this function on the system is less critical than that of the position pulse.

Transmission breakdowns are detected by a transmission checking circuit 8. This circuit checks when the vehicle emits a position pulse via transmitter 18; it receives the same pulse back from the station PCC through receiver 18 (see FIGS. 1 and 2A).

If circuit 8 clearly receives the position pulse which has been generated in loop 90 itself, it will also receive clearly all the others, since the transmission conditions are identical. If this is not the case, it detects a transmission breakdown and sends an appropriate signal to the safety AND gate 7.

The block diagram of the anti-collision safety device presented is justified at the level of the processing of the alarm signals.

The safety degree of the system is not measured by the safety given by carrying out the safety functions, but by the detection and the transmission of breakdowns of the device.

In general, contrary to the known safety devices, breakdowns are detected by coincidence, and the output of the coicidence circuits actuates the stopping operation. The breakdown detection circuit itself is designed to actuate the stopping operation directly, if it breaks down. These circuits are called "positive or intrinsic safety circuits."

In the circuit shown in FIG. 1, the safety circuits are of the negative logical type.

Thus, as soon as one of the AND gates 7,14 or 14' receives a breakdown signal (a logical zero), the output furnishes a zero signal.

The rules used for obtaining anti-collision safety are the following:

all detection of a collision risk, or breakdown of any anti-collision safety circuit, causes the emergency stop of a vehicle, all simultaneous breakdowns of the two anti-collision safety loops for any vehicle cause the emergency stop of the line.

POSITION PULSE ALARM 7, 9, 19, 21, 24

In order to comply with the preceding conditions, the position pulse is generated twice in each loop (that is, four times for the assembly). This precaution is taken in a way such that a vehicle which detects a breakdown of the safety device is not obliged to require the emergency stop of the entire line.

Thus, in case of breakdown, the vehicle that has broken down must be stopped on an emergency basis and any following vehicles must be protected; a vehicle which detects a breakdown of a safety loop will thus always emit its real position to the following vehicle. On the other hand, if a breakdown is detected in both safety loops, the following vehicle is no longer protected in every case; an emergency line stop command is then given, which is the only effective way of warning the following vehicle.

Since a breakdown of the stud detector 1, or a breakdown in transmission in a loop leads also to a position pulse breakdown, an alarm is generated which is a synthesis made by the negative logical AND gate 7 of:

a breakdown of the position pulse 5 generation, a breakdown of the detector 1, detected by circuit 1', or a breakdown in transmission, detected by circuit 8.

When one of these breakdowns is detected on board, in a vehicle loop, an alarm signal from this loop is sent to the central station PCC, by means of circuits 9, 19, 21 and 24, under safe conditions.

If the alarm signals of the loop 90 and the loop 100 are received simultaneously by the station PCC 25, the vehicle following the vehicle which emitted the two alarm signals is no longer protected; the station PCC therefore calls for the emergency stop of the line by means of the circuits 26,27, 28 and 17.

Contrary to the preceding alarm signal, the stopping distance alarm pulse from circuit 13, to OR gate 16, concerns only the vehicle that has broken down. If a vehicle can no longer determine its stopping distance, it endangers the safety of the other vehicles, and ensures its own by an emergency stop (the station PCC is not concerned).

Any breakdown of the stopping distance pulse arrangement is detected by the coincidence circuit 13 under safe conditions.

The distance window signal from circuit 6 is produced under safe conditions so that any breakdown of this function leads to the disappearance of the window; the AND safety gate 14 thus brings about the emergency stop of the vehicle.

INHIBITION OF ALARMS

At the output of the AND safety circuits 7,14, which control the emergency brake, are placed the OR safety circuits 15,16, which enable the actuation of the brake to be inhibited by remote safety commands TC in one loop or the other, but not in the two loops simultaneously. These safety remote commands TC are such that any breakdown of these remote commands or any simultaneous dispatch of the two remote commands, causes the inhibitions to be suppressed.

These inhibitions enable a vehicle to start again with a broken-down safety loop. Authorization for this can be given only if sufficient space has been made on both sides of the broken down vehicle, and only to return the vehicle to its shed. Thus, a safety loop is always available to protect the vehicles. If the second alarm operates, the vehicle must return to its shed with the aid of the following vehicle, which pushes it in.

The transmission of the "position pulse" alarm signals from circuit 9 is made under safe conditions using the same transmitter 19 as the position pulse itself, to PCC circuits 21,24.

Figure 4:
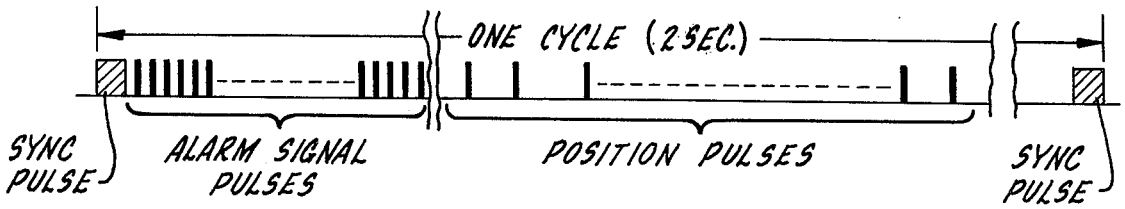
FIG. 4 represents the signals received by the central control station, as a function of time, for a non-collision sequence.

In the case of the particular embodiment illustrated, the first 300 milliseconds of the anti-collision cycle are used for this purpose; this is the time between the emission of two synchronization pulses, that is, 2 seconds, emitted by the station PCC (FIG. 4).

When a vehicle receives a synchronization pulse, it transmits, through the transmitter 19, a pulse that is delayed with respect to the synchronization pulse by a time characteristic of and constituting an identification of that particular vehicle.

An alarm indicative of a breakdown is transmitted to the station PCC by suppressing the emission of this pulse in the loop which generated the alarm.

The signal received by the station PCC normally has the following structure, in each of the loops 90 and 91, when all the vehicles are on the line (FIG. 4).

If there is a breakdown in one of the two anti-collision loops of a particular vehicle, the suppression of the alarm pulse on the corresponding transmission line will be detected by the circuit 24 in station PCC.

The equipment of the station PCC for anti-collision safety, consists, in addition to the two sets of safety transmitters and receivers and the synchronization pulse generators, of a safety logic which decides on the emergency stop of the line, if there is an alarm state simultaneously in the two loops of the same vehicle, with which is combined a manual emergency stop control of the line TC′ sent to the AND gate 26.

This line emergency stop command is given under safe conditions with the aid of a transmitter 27 radiating a constant-frequency signal onto a wire placed along the track, namely, the safety frequency. All the vehicles detect this frequency with the aid of an antenna and a receiver 28. If a vehicle receives this frequency, it operates normally; if not, it actuates the emergency brake. If the station PCC decides on the emergency stop of the line, all it needs to do is to interrupt the transmission of the safety frequency by transmitter 27.

It can be important to protect a section of the line from all vehicles which arrive in this section, without however, influencing the vehicles which have already passed through this section. The circuit 29 in station PCC is used to this end to simulate a vehicle that has stopped in this part of the line (this can be, for example, for protecting some points, repairs to the track, an area where the line is broken, etc.). To simulate a vehicle that has stopped on the track, the station PCC, by means of its transmitters, introduces, in addition to the synchronization pulse and the position pulses of the vehicles of the line, a position pulse generated by the station PCC which corresponds to that of a fictitious vehicle that has stopped on the track. The position of this pulse in the anti-collision sequence fixes the point on the track where the presence of a vehicle has been simulated.

In a similar manner, to avoid an emergency stop of the line when less than all of the vehicles are on the line, it is necessary to simulate the alarm pulses of the vehicles in their shed. This simulation is made under safe conditions, for it is impossible to introduce onto the track a vehicle of which the alarm signals have been simulated. To this end, the numbers of the vehicles in their shed are introduced directly at circuit 24 so that the check made of the alarm signals is complete.

Lastly, the position counters serving to generate the position pulses are re-set at the terminal/arrival and terminal/departure stations.

To synopsize operation of the invention, and specifically the embodiment described above, the synchronization signal generator 22, actuated by clock 30, generates a series of sync pulses at equally spaced intervals, for example every two seconds. These sync pulses are transmitted to all vehicles on the line by the central station safety transmitter means comprising OR gate 23 and transmitter 20. The sync pulses are of relatively long duration (20 milliseconds) and are readily detected in each of the two detectors 4 and 4′ connected to the output of the safety receiver 18 in each vehicle control unit V.

The stud detector 1 and counter 2, in combination, afford a distance measuring means for continuously measuring the distance of the vehicle from the zero point or terminal point from which the vehicle is moving. Detector 1 and counter 2′ afford an alternate or duplicate distance measuring means; however, as noted above, counter 2′ is preferably a different type from counter 2 to avoid malfunctions that might effect one kind of counter and not the other. Each time a sync pulse is received and detected by the detector 4, the position signal generator comprising delay circuit 3 is actuated to generate a local position signal which is the position signal for the vehicle in which unit V is mounted. This local position signal occurs at a time representative of the distance of the vehicle from the terminal point. Similarly, the alternate position signal generator means comprising delay circuit 3′ is actuated by the sync pulse from detector 4′. The position signal generator is applied by coincident circuit 5, which supplies a local position pulse to the vehicle safety transmitter 19 only when both the delay circuits 3 and 3′ produce position pulses simultaneously. Transmitter 19 transmits the local position pulse to the central station receiver 21, which immediately applies all position received pulses back to the safety transmitter 23,20 for re-transmission to all vehicles, thus completing a control loop linking each vehicle with the central control station PCC.

After each local position signal, the stop distance means comprising tachometer 10, function generator 11, and delay circuit 12, generates the vehicle stop distance signal 111 (FIG. 3H). In coincident circuit 14′ this stop distance signal for the vehicle is effectively compared with the distance window signal initiated upon generation of the local position pulse signal and terminated when the next position pulse is received, the latter identifying the distance to the next preceding vehicle. If the stop distance signal occurs before the next position signal, that is before the end of the distance window signal, AND gate 14′ supplies an input to the following gate 14 that does not actuate the vehicle brakes. On the other hand, if the stop distance signal from delay circuit 12 occurs after the first position signal received following the local position signal, then gate 14′ supplies an appropriate signal to gate 14 that operates the vehicle brakes, through gates 15 and 17, because the preceding vehicle is too close for safety.

Any time there is a discrepancy in the counts of the two counters 3 and 3′ in the distance measuring apparatus of vehicle control unit V, this discrepancy is detected because gate 5 does not receive simultaneous inputs from circuits 3 and 3′. In effect, therefore, gate 5 functions as a distance count comparator. When a lack of coincidence is detected, circuit 5 supplies an appropriate output signal to gate 7 to actuate the brake control means in vehicle unit V and apply the vehicle brakes, it being apparent that there has been a malfunction in the distance measuring circuits of the control unit.

In the device of the disclosed embodiment of the invention, it will be apparent that the sync pulse detectors 4 and 4′ can readily distinguish the sync pulses from the alarm pulses and position pulses on the basis of pulse duration. The stud detector 1 may be essentially similar to the many inductive wheel detectors commonly employed in the railroad art, and the studs may comprise small plates mounted on the supporting ties of a railway, preferably at the middle of the track to avoid interference with the rails and related structures. Although the described system, with the primary distance measurement being effected from the detector sensing reference point indicators (studs) actually mounted along the track, is preferred, it will be apparent that the control can be changed to utilize a tachometer, such as tachometer 10, instead of stud detector 1. This modification, on the other hand, has the disadvantage that it is not directly linked to the actual track system as the preferred construction.

The transmission check means comprising circuit 8 effectively monitors the control loop 90,91 to make certain that transmission is being maintained, a check being made after each sync pulse (every 2 seconds). Of course, if the transmission link to the central control station is not open, control has been lost and the vehicle should be stopped. This is accomplished by the connection from circuit 8 to the vehicle brakes afforded by circuits 7,14, 15 and 17. On the other hand, any failure of the basic means for sensing movement of the vehicle along the track, stud detector 1, or of the movement sensor that provides the basic speed information for determination of a safe stopping distance, tachometer 10, affords equal reason for stopping the vehicle. This is accomplished by comparator 1′, which compares the outputs of the two movement sensors 1 and 10 and actuates the vehicle brakes through circuit 7,14 15 and 17 if any substantial discrepancy appears.

As noted above, as long as there is a failure in only one of the two loops linking each vehicle to the central control station PCC, the danger is localized and there is no need to stop vehicles on the line. This is particularly true because counters 2 and 2′ are reset to zero only at each terminal point and the vehicle will continue to supply vehicle information through at least one loop even if the other loop is malfunctioning or if the vehicle is stopped. On the other hand, failure of both loops in any vehicle presents a condition in which all following vehicles may be endangered and do not receive sufficient information for self protection. This exigency is prevented by the interconnection of the two central station loops 91 and 101 afforded by alarm detector 24, the similar alarm detector in circuit 101, and the transmitting means comprising gates 25 and 26 and transmitter 27. Under the recited conditions transmitter 27 effectively supplies a general brake signal to all vehicles. In the illustrated control unit V, this signal is received by receiver 28 and is applied to gate 17 to actuate the vehicle brakes. The same action would occur on all other vehicles on the line. Of course, the general or emergency brake signal could be transmitted through transmitter 20 and receiver 18, using appropriate modulation that would be compatible with the other signals transmitted through that linkage, but a separate transmission arrangement is preferred, as illustrated.

It is obvious that the invention is not limited to the embodiment herein described and illustrated, and that on the basis of it, other modes and forms of embodiment can be envisaged without departing from the scope of the invention.

We claim:

1. An anti-collision safety control for a plurality of vehicles moving along a track away from a given terminal point, including a corresponding plurality of vehicle control units, one on each vehicle, and a central control station, in which the central control station comprises:

central safety receiver means for receiving position signal from the vehicles;

a synchronization signal generator for generating a series of sync signals; and central safety transmitter means for transmitting the sync signals and the received position signals to all of the vehicles; and in which each vehicle control unit comprises:

distance measuring means for continuously measuring the distance of the vehicle from the terminal point;

vehicle safety receiver means for receiving the sync signals and position signals from the central control station;

position signal generator means, coupled to the distance measuring means and to the vehicle safety receiver means, for generating a local position signal for the vehicle carrying the control unit, following a received sync signal, at a time representative of the distance of the vehicle from the terminal;

vehicle safety transmitter means for transmitting the local position signal to the central control station to complete a control loop linking the vehicle and the central control station;

stop distance means, coupled to the position signal generator means, for generating a vehicle stop distance signal, following the local position signal, at a time representative of a safe stopping distance for the vehicle;

and vehicle brake control means, coupled to the vehicle safety receiver means and the stop distance means, for actuating the brakes of the vehicle whenever the next position signal following the local position signal is received prior to the stop distance signal.

2. An anti-collision safety control for track vehicles, according to claim 1, for use in conjunction with a series of equally spaced reference point indicators along the track, in which the distance measuring means in each vehicle control unit comprises:

a reference point detector for detecting movement of the vehicle past the reference point indicators;

and a counter, coupled to the reference point detector, for counting the number of reference points traversed by the vehicle to thereby determine distance of the vehicle from the reference point.

3. An anti-collision safety control for track vehicles, according to claim 2, in which each vehicle control unit further comprises:

a second counter, coupled to the reference point detector, for counting the number of reference points traversed by the vehicle;

and distance count comparator means, coupled to both counters, for comparing the counts in the counters, the vehicle brake control means being coupled to the distance count comparator means and actuating the vehicle brakes when the comparator means identifies a discrepancy of the count in the two counters indicative of a malfunction of the distance measuring means.

4. An anti-collision safety control for track vehicles, according to claim 3, in which the two distance measuring counters are different in construction and operation from each other.

5. An anti-collision safety control for track vehicles, according to claim 1, in which the stop distance means comprises:

tachometer means for generating a speed signal representative of the actual speed of the vehicle;

and function generator means, coupled to the tachometer means and actuated by the local position signal, for generating the stop distance signal in accordance with a predetermined function of actual vehicle speed.

6. An anti-collision safety control for track vehicles, according to claim 1, in which each vehicle control unit further comprises:

transmission check means, coupled to the vehicle safety receiver means, and to the position signal generator means, for comparing the received position signals with the local position signal to ascertain whether the local position signal is repeated in the received position signals;

the vehicle brake control means being coupled to the transmission check means to actuate the vehicle brakes when the local position pulse is not repeated in the received position signals, indicating a malfunction in the safety transmission system.

7. An anti-collision safety control for track vehicles, according to claim 1, in which the distance measuring means in each vehicle control unit comprises first movement sensing means for sensing movement of the vehicle along the track and generating a first distance pulse signal indicative thereof;

and in which each vehicle control unit further comprises:

second movement sensing means for sensing movement of the vehicle along the track and generating a second distance pulse signal indicative thereof;

movement comparator means for comparing the first and second distance pulse signals;

and means coupling the movement comparator means to the vehicle brake control means to actuate the vehicle brakes whenever the movement comparator means determines a discrepancy of predetermined magnitude between the first and second distance pulse signals.

8. An anti-collision safety control for track vehicles, according to claim 7, in which the movement comparator means is an up-down counter, in which one distance pulse signal actuates the counter to count up and the other actuates the counter to count down, and in which a count of a predetermined magnitude in the up-down counter, either up or down, is applied to the vehicle brake control to actuate the brakes.

9. An anti-collision safety control for track vehicles, according to claim 7, in which one movement sensing means is a tachometer and the other is a detector which detects a series of reference point indicators located at equally spaced points along the track.

10. An anti-collision safety control for track vehicles, according to claim 1, in which:

the central control station includes a second central safety receiver means and a second central safety transmitter means;

each vehicle control unit includes a second distance measuring means, a second vehicle safety receiver means, a second position signal generator means, a second vehicle safety trasmitter means, a second stop distance means, and a second vehicle brake control means, the second safety receiver and transmitter means of each vehicle control unit being linked in a second control loop with the central station, independent of the first control loop;

each vehicle control unit including two alarm signal means, one in each control loop, for generating and transmitting to the central control station an alarm signal indicative of a malfunction in the vehicle unit portion of the control loop; the central control station further comprising:

two alarm signal detectors, one in the central station portion of each control loop; and general brake signal transmitting means, coupled to both alarm signal detectors, for transmitting a general brake signal to the vehicles whenever the alarm signal detectors detect an alarm signal from both control loops of any vehicle;

and each vehicle control unit further comprising general brake signal receiving means for actuating the vehicle brakes in response to a received general brake signal.

* * * * *